US006393625B1

(12) United States Patent
Tsai

(10) Patent No.: US 6,393,625 B1
(45) Date of Patent: May 28, 2002

(54) PLUMBING DEVICE FOR A BASIN DRAINAGE

(76) Inventor: John Tsai, 27F, No. 29-3, Sec. 2, Chung-Cheng E. Rd., Tan-Shui Chen, Taipei Hsien (TW)

( * ) Notice: Subject to any disclaimer, the term of this patent is extended or adjusted under 35 U.S.C. 154(b) by 0 days.

(21) Appl. No.: 09/989,506

(22) Filed: Nov. 20, 2001

(51) Int. Cl.[7] ..... E03C 1/308
(52) U.S. Cl. ..... 4/255.02
(58) Field of Search ..... 4/255.01–255.12; 15/104.03, 104.05

(56) References Cited

FOREIGN PATENT DOCUMENTS

FR 2 417 347 * 10/1979 ..... 4/255.02
GB 2 268 994 * 1/1994 ..... 4/255.02

* cited by examiner

*Primary Examiner*—Charles R. Eloshway
(74) *Attorney, Agent, or Firm*—Thomas, Kayden, Horstemeyer & Risley LLP

(57) ABSTRACT

A plumbing device for a basin drainage includes a pushbutton, a spring, a positioning sleeve, a probe and a seal that is connected to the probe. The pushbutton is able to control the movement of the seal to selectively communicate the inlet and the valve receiving channel. A moving chamber is movably received in the pressure chamber to control the communication between the pressure release path and the passage of the cap. The accumulated pressure in the pressure chamber is able to be released by pushing the pushbutton so as to generate a large force into the drainage with the suction cup securely engaged with the periphery of the drainage.

4 Claims, 4 Drawing Sheets

PLUMBING DEVICE FOR A BASIN DRAINAGE

BACKGROUND OF THE INVENTION

1. Field of the Invention

The present invention relates to a plumbing device, and more particularly to a plumbing device for a basin drainage, with which a large force generated inside the pressure chamber of the plumbing device is able to force the sucking disk attached to the front end of the plumbing device to move toward the basin drainage to create a sudden push inside the plumbing drainage to clear the obstacle inside the basin drainage.

2. Description of Related Art

In daily life, we often accidentally drop something into the basin drainage. If this "something" is dissolvable, the basin drainage will not be blocked. However, if the obstacle inside the basin drainage is not dissolvable, the user needs to find a plumber man to clear the obstacle. Usually, the plumber man uses a resilient stainless wire to extend into the basin drainage to push the obstacle out of the drainage or to remove it from the drainage. The entire process is too time consuming and costly.

To overcome the shortcomings, the present invention tends to provide an improved plumbing device to mitigate and obviate the aforementioned problems.

SUMMARY OF THE INVENTION

The primary objective of the present invention is to provide a plumbing device for a basin drainage. The plumbing device has a pressure release valve mounted beside the pump to temporarily create a pressure drop between a cover and a moving chamber so that the moving chamber will be pushed to engage with the cover to allow the pressure built up inside the pressure chamber to be released from the central passage. With the released pressure, the suction cup is securely engage with the outer periphery of the basin drainage and thus the obstacle inside the drainage will be pushed by the sudden pressure and eventually be forced out of the drainage.

Other objects, advantages and novel features of the invention will become more apparent from the following detailed description when taken in conjunction with the accompanying drawings.

DETAILED DESCRIPTION OF THE PREFERRED EMBODIMENT

Figure 1:
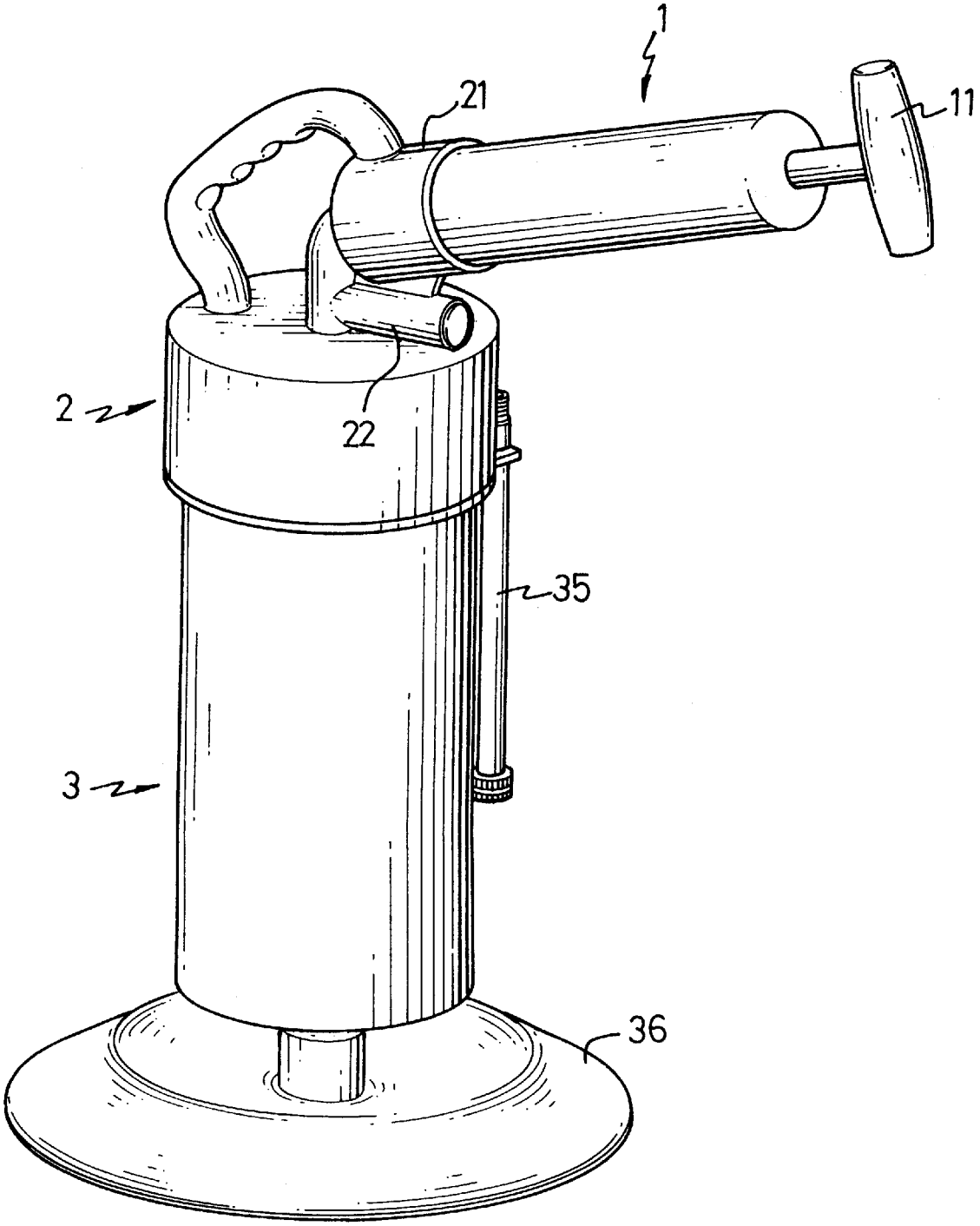
FIG. 1 is a perspective view of the plumbing device of the present invention.
Figure 2:
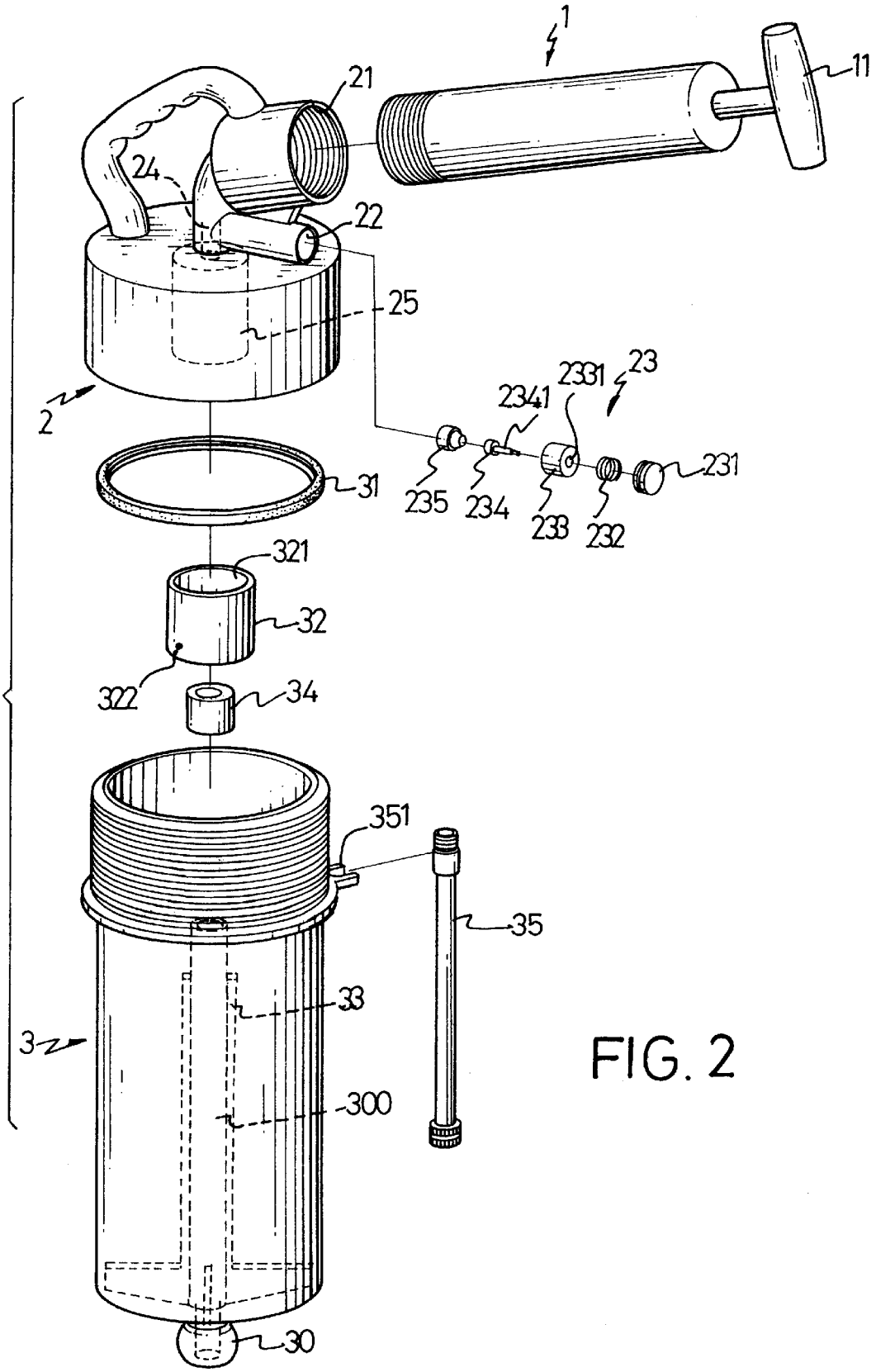
FIG. 2 is an exploded perspective view of the plumbing device in FIG. 1.

With reference to FIGS. 1 and 2, the plumbing device in accordance with the present invention has a pump (1), a cap (2) and a pressure chamber (3).

The pump (1) has a handle (11) so that the user is able to reciprocally operate the handle (11) to pump air out of the pump (1). The cap (2) has an inlet (21) formed to mate with a free end of the pump (1) to receive the pumped air from the pump (1). A valve receiving channel (22) is formed to receive therein a pressure release valve (23) which comprises a pushbutton (231), a spring (232), a positioning sleeve (233), a probe (234) and a seal (235) that is connected to the probe (235). The seal (235) is securely received outside the valve receiving channel (22) to seal the communication between the valve receiving channel (22) and the inlet (21). The probe (234) has an extension (2341) extending through a through hole (2331) defined in the positioning sleeve (233) and the spring (232) to securely connect to the pushbutton (231). The spring (232) is a compression spring such that the pushbutton (231) and the positioning sleeve (233) is spaced apart from each other. A passage (24) is defined to communicate the inlet (21) and the valve receiving channel (22) and extends to a bottom face defining a cover (25). That is, the seal (235) is received in the passage (24). The pressure chamber (3) is securely screwed to the cap (2) and has a sealing (31) provided on a top peripheral edge of the pressure chamber (3) so that when the pressure chamber (3) is connected to the cap (2), an air-tight seal is accomplished between the cap (2) and the pressure chamber (3). The pressure chamber (3) further has a cylindrical moving chamber (32) with an open end (321) and a bore (322) defined in a side face of the moving chamber (32). The moving chamber (32) is movably received in the pressure chamber (3) and connected to the cover (25) so as to alternately receive the cover (25) from the open end (321). A pressure release path (33) is formed in the pressure chamber (3) to communicate with the air and has a rubber pad (34) provided on top of the pressure release path (33) to engage with a bottom face of the moving chamber (32). An air hose (35) is attached to a side of the pressure chamber (3) by a clamp (351) formed on a side face of the pressure chamber (3). A suction cup (36) having a head receiving recess (361) is detachably provided on a head (30) formed on a bottom face of the pressure chamber (3) and having an air path (300) communicating with the pressure release path (33).

When the plumbing device of the present invention is assembled, the suction cup (36) is connected to the pressure chamber (3) with the head (30) received in the head receiving recess (361). The rubber pad (34) is mounted on top of the pressure release path (33) and the moving chamber (32) is rested on top of the rubber pad (34). After the pressure chamber (3) is screwed to the cap (2) with the sealing (31) received between the pressure chamber (3) and the cap (2), the cover (25) is received in the moving chamber (32). Furthermore, the pressure release valve (23) is received in the valve receiving channel (22) and the pump (1) is securely received in the inlet (21) of the cap (2).

Figure 3:
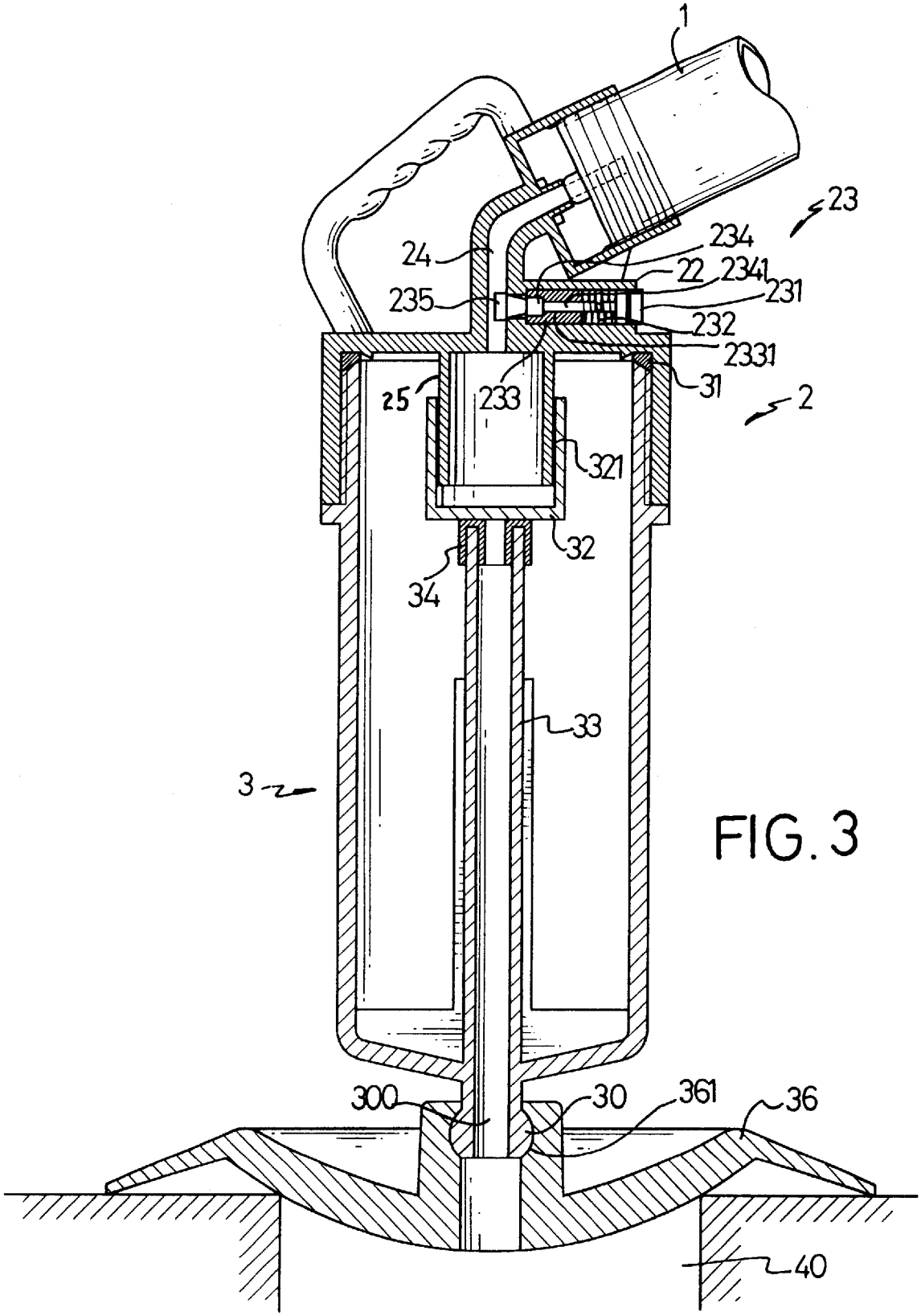
FIG. 3 is a cross sectional view showing the structure of the plumbing device after assembled.
Figure 4:
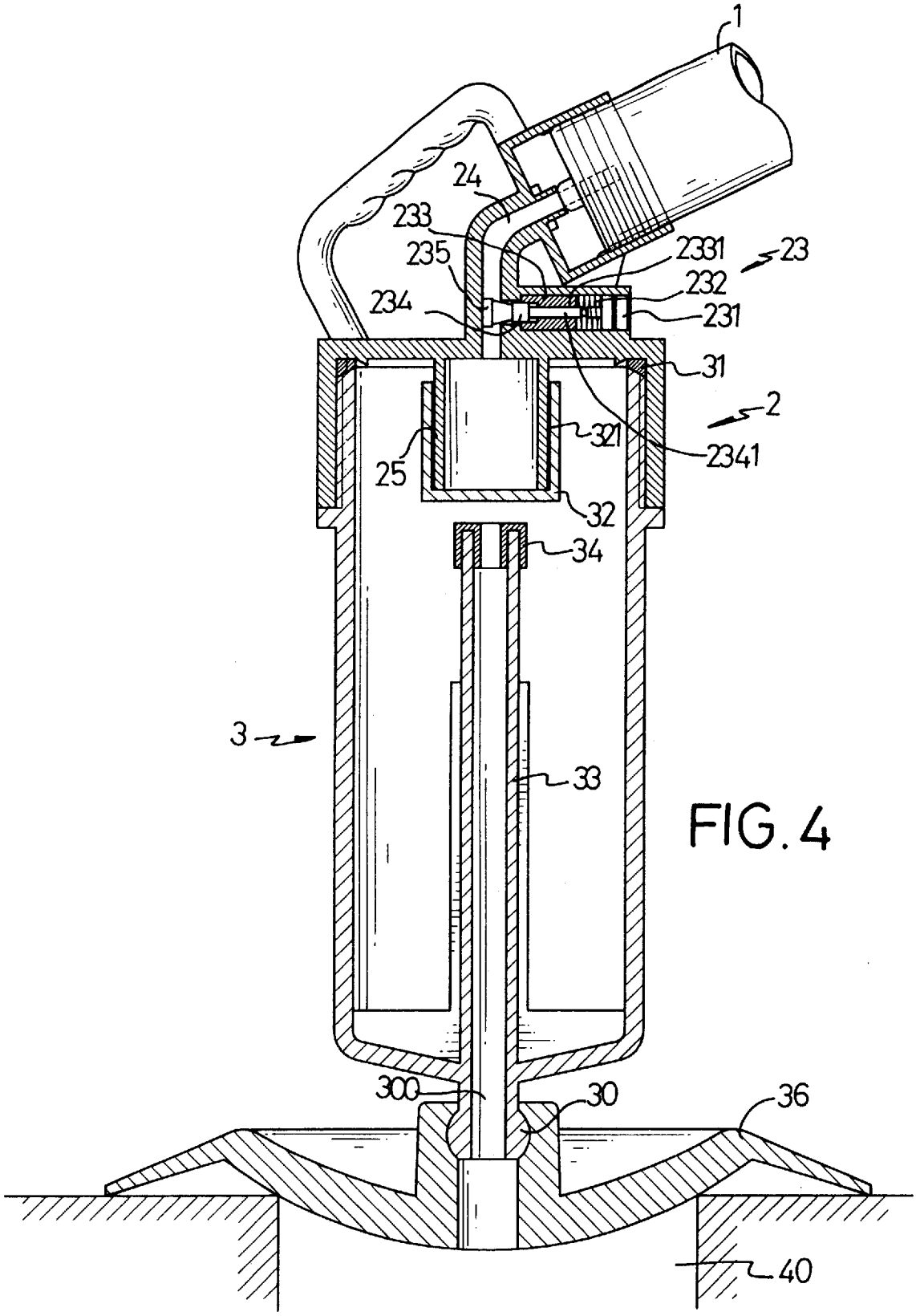
FIG. 4 is an operational cross sectional view showing the movement of the moving chamber to engage with the cover to allow the pressure inside the pressure chamber to be released to push the suction cup in front of the plumbing device of the present invention.

With reference to FIGS. 3 and 4, when the user reciprocally operates the handle (11) to pump air into the inlet (21) after the suction cup (36) engages with an outer periphery of a drainage (40), the air flows through the passage (24) and into the moving chamber (32) to force the moving chamber (32) to further enhance the engagement with the pressure release path (33). Because the moving chamber (32) rests on top of the pressure release path (33), the pumped air can not flow out through the pressure release path (33) and can only accumulate inside the pressure chamber (3). When the user feels that the pressure inside the pressure chamber (3) is enough, the user presses the pushbutton (231) to force the seal (235) to release the seal between the passage (24) and the inlet (22). At the moment the user presses the pushbutton (231), a sudden pressure drop occurs in the inlet (22) and the passage (24), which causes a temporary, sudden suction force to suck the moving chamber (32) upward so as to leave the engagement with the pressure release path (33). Therefore, the pressurized air in the pressure chamber (3) is able to escape from the pressure release path (33) and ejects out of the pressure chamber (3) from the air path (300). In addition, to avoid the engagement force between the moving chamber (32) and the cover (25) being too large when the pressure drop occurs, the bore (322) communicates the inside of the moving chamber (32) and the pressure chamber (3) so that the suction force to the moving chamber (32) by the sudden pressure drop will soon disappear after a balance is reached between the inside of the moving chamber (32) and the pressure chamber (3). It is seen from the drawings that the reciprocal movement of the pushbutton (231) creates a temporary pressure drop in the inlet (21) and the passage (24), which also creates a suction force to the moving chamber (32). Because the suction force moves the moving chamber (32), the pressurized air in the pressure chamber (3) is able to escape from the pressure release path (33) to move the suction cup (36) and thus accomplishes the purpose of clearing the obstacle in the basin drainage.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plumbing device for a basin drainage, the plumbing device comprising:

a pump having a handle to pump air out of the pump;

a cap having an inlet formed to mate with a free end of the pump to receive the pumped air from the pump, a valve receiving channel formed to receive therein a pressure release valve which comprises a pushbutton, a spring, a positioning sleeve, a probe and a seal that is connected to the probe, a passage defined to communicate the inlet and the valve receiving channel and extending to a bottom face of the cap, wherein the seal is securely received in the passage to selectively seal the communication between the valve receiving channel and the inlet, and a cover formed on the bottom face of the cap;

a pressure chamber securely screwed to the cap and having a sealing provided on a top peripheral edge of the pressure chamber so that when the pressure chamber is connected to the cap, an air-tight seal is accomplished between the cap and the pressure chamber, a cylindrical moving chamber movably received in the pressure chamber and provided with an open end corresponding to the cover and a bore defined in a side face of the moving chamber for achieving a pressure balance between the moving chamber and the pressure chamber, a pressure release path formed in the pressure chamber to communicate with the air and to selectively communicate with the passage and having a rubber pad provided on top of the pressure release path to selectively engage with a bottom face of the moving chamber; and a suction cup having a head receiving recess defined to detachably receive therein a head formed on a bottom face of the pressure chamber and having an air path communicating with the pressure release path.

2. The plumbing device as claimed in claim 1, wherein the probe has an extension extending through a through hole defined in the positioning sleeve and the spring to securely connect to the pushbutton so that the seal will be driven to move by the pushbutton to selectively block the communication between the inlet and the valve receiving channel.

3. The plumbing device as claimed in claim 2, wherein the spring is a compression spring such that the pushbutton and the positioning sleeve are spaced apart from each other.

4. The plumbing device as claimed in claim 3 further comprising an air hose attached to a side of the pressure chamber by a clamp formed on a side face of the pressure chamber.

* * * * *